US012796849B2

(12) United States Patent
Williams

(10) Patent No.: US 12,796,849 B2
(45) Date of Patent: Nov. 17, 2026

(54) PARTITION HOOK WITH DOOR CLOSED KEEPER

(71) Applicant: Heather Williams, Boulder, CO (US)

(72) Inventor: Heather Williams, Boulder, CO (US)

( * ) Notice: Subject to any disclaimer, the term of this patent is extended or adjusted under 35 U.S.C. 154(b) by 0 days.

(21) Appl. No.: 16/849,824

(22) Filed: Apr. 15, 2020

(65) Prior Publication Data

US 2022/0167771 A1 Jun. 2, 2022

(51) Int. Cl.
*A47G 25/06* (2006.01)
*A47G 29/08* (2006.01)

(52) U.S. Cl.
CPC ..... *A47G 25/0614* (2013.01); *A47G 29/083* (2013.01)

(58) Field of Classification Search
CPC ..... A47G 25/0614; A47G 25/0607; A47G 25/0692; A47G 25/06; A47G 29/083; A47G 1/02; A47G 1/16; A47G 1/1653; A47G 42/00
USPC .... 248/339, 304, 305, 301, 303, 308, 316.7, 248/316.1, 316.2, 316.6, 914, 229.11, 248/229.13, 229.21, 229.23, 228.2, 228.4, 248/230.2, 230.4, 231.31, 231.51
See application file for complete search history.

(56) References Cited

U.S. PATENT DOCUMENTS 638,813 A * 12/1899 Ryan ..... A47G 25/0614 248/294.1
712,492 A * 11/1902 Broga ..... A47G 23/0225 248/215
965,151 A * 7/1910 Benjamin ..... A47G 25/08 248/308
1,102,785 A * 7/1914 Mohlberg ..... A47G 29/083 248/231.71
1,503,083 A * 7/1924 Amey ..... B60R 9/02 224/42.39
1,661,837 A * 3/1928 Little ..... E06C 7/14 248/211
1,751,198 A * 3/1930 Franck ..... A47G 29/083 248/215
2,211,273 A * 8/1940 Kleckner ..... F16G 17/00 24/598.5

(Continued)

*Primary Examiner* — Nkeisha Smith

(57) ABSTRACT

An attachable partition hook operable to support a carrying parcel includes a first hook having a first stem and a first curvature. The partition hook includes a joint affixed to an end of a said first stem. The partition hook includes a second hook having a second stem, a second curvature, and a hollow socket affixed to the end of the second stem, wherein the hollow socket is configured to retain the joint of the first stem. The partition hook includes a second hook having a second stem, a second curvature, and a hollow socket affixed to the end of the second stem, wherein the hollow socket is configured to retain the joint of the first stem. The partition hook includes a first hollow retaining portion positioned on the stem of the first hook, wherein the hollow retaining portion comprises of a first extending arm. The partition hook includes a second hollow retaining portion positioned on the end of the first curvature of the second hook, wherein the hollow retaining portion comprises of a second extending arm. Additionally, the joint of the first hook is coupled to the socket of the second hook, wherein the first hook and the second hook are positioned to be oriented perpendicular to each other and operable to rotate on a single axis.

8 Claims, 3 Drawing Sheets

(56) References Cited

U.S. PATENT DOCUMENTS 2,262,282 A * 11/1941 Helgason ..... E06C 7/14 248/211
2,286,539 A * 6/1942 Hagerstrom ..... A47G 1/20 248/201
2,453,189 A * 11/1948 Bogut ..... E06C 7/146 248/211
3,313,507 A * 4/1967 Belli ..... E06C 7/14 248/211
3,376,006 A * 4/1968 Zezula ..... A47G 29/083 248/227.2
4,312,455 A * 1/1982 Weber ..... A47G 29/083 211/119.005
5,094,417 A * 3/1992 Creed ..... A47G 29/083 248/215
6,481,680 B2 * 11/2002 Neuman ..... A47G 29/083 248/215
6,964,085 B2 * 11/2005 Boda ..... A47B 57/54 24/489
7,086,352 B2 * 8/2006 Goodger ..... A01K 31/12 119/537
7,254,915 B2 * 8/2007 Mrotek ..... A01K 97/01 248/227.1
7,789,358 B1 * 9/2010 Adams ..... E04G 5/003 248/211
7,828,258 B2 * 11/2010 Shigio ..... A47G 29/083 248/308
8,002,225 B1 * 8/2011 Malone ..... A47B 81/00 248/214
8,308,125 B2 * 11/2012 Losaw ..... A47G 29/083 248/690
8,668,177 B2 * 3/2014 Stein ..... A47G 29/083 248/308
9,560,927 B2 * 2/2017 Krumpe ..... A47G 25/0607
9,591,938 B2 * 3/2017 Andrews ..... A47G 29/083
10,570,948 B1 * 2/2020 Leslie ..... A47G 25/0678
10,675,172 B2 * 6/2020 Kovacevic ..... A61F 5/3707
10,889,249 B1 * 1/2021 Snyder ..... A47F 5/0006
2005/0056746 A1 * 3/2005 Landver ..... A47G 29/083 248/914
2006/0255220 A1 * 11/2006 Skripps ..... A61G 13/101 248/228.4
2010/0108838 A1 * 5/2010 DeMartine ..... F16M 11/10 248/222.14
2013/0306823 A1 * 11/2013 Liu ..... A47G 29/083 248/339
2014/0042287 A1 * 2/2014 Stein ..... A47G 29/083 248/324
2015/0306447 A1 * 10/2015 Neal-Buhler ..... A63B 21/0557 248/231.81
2016/0286995 A1 * 10/2016 Stammnitz ..... A47G 25/0685
2020/0107635 A1 * 4/2020 Mitchell ..... A47G 25/0614

* cited by examiner

PARTITION HOOK WITH DOOR CLOSED KEEPER

FIELD OF THE INVENTION

The present invention relates generally to carrying bag hanging devices, attachable hanging hooks for suspending a carrying bag from a door, and in particular a security tool for holding a door closed. Specifically, this invention relates to a attachable partition hook operable to support a carrying parcel.

BACKGROUND OF THE INVENTION

The following description includes information that may be useful in understanding the present invention. It is not an admission that any of the information provided herein is prior art or relevant to the presently claimed invention, or that any publication specifically or implicitly referenced is prior art.

Hanging garment bags are known in the art, as they provide convenience and the ability to prevent valued luggage and articles from touching the floor, ensure the cleanliness, and ensure the tidiness of the object. The need for a hook that allows one to access all compartments of the bag, when there is no suitable place for placing a bag down is a useful tool to utilize when constantly on the move.

When traveling, people constantly find themselves in positions where they are required to multi-task and hold multiple items of various weights and sizes. One example is when a person enters a public restroom, where the stalls are narrow, lack proper space to hang a bag, and the hooks on the back of the door are not sufficiently constructed to hold a heavy bag without opening up the restroom partition door. Another example, is when a person needs to free their hands and temporarily hang a bag or another item to a support surface or ledge. Another example is when a person is traveling and needs to temporarily connect one piece of luggage to another, to a luggage cart, or to another surface, all while holding travel documents.

Due to these various encumbrances and the state of the requirement of multi-tasking and safety needed for the public, a device which can withhold a bag of various sizes and weights, while also functioning as an added security measure, is useful to the public. In accordance with the invention, it is an object of the present disclosure to solve these problems.

As such, there is a need for a portable door hook, which can hold significant weight, when an object is secured to the hook, while also preventing the door to be secured in place, without opening due to the weight of the secured object.

Embodiments of the invention, on the other hand, provide significant advantages while overcoming the above-described and other disadvantages, as will now be described.

SUMMARY OF THE INVENTION

For the foregoing reasons, there is as need for a versatile attachable partition hook operable to support a carrying parcel. It is further desirable for the attachable partition hook to secure a doorway, while also carrying packages, luggage, and bags of different sizes and weights.

Accordingly, the inventor has therefore recognized the aforementioned inherent problems and lack in the art and observed that there is a need for a device in which the versatility of a partition hook with door closed keeper can be made available to support all styles, sizes, and weights of carried bags.

Hinged doors can often be breached, opened, or inadvertently opened by the weight of one's bag that is hanging from a hook. Enough weight of a bag can defeat a door's, such as a restroom door, locking mechanism that are often cheaply made, and constructed.

The inventor has recognized the aforementioned problems and has addressed this need by developing a partition hook with a door closed keeper that provides a means to attach almost any type of bag to any type of surface, thus keeping them off of the floor in a manner which is quick, easy, and effective, while also providing security in the event of the hook being placed on a door. The present invention provides a tool for securing a closed swinging "push" door and preventing against opening away from the occupant under the application of the weight of a bag, or an applied force.

The inventor has thus realized the advantages and benefits of providing an attachable partition hook having a first hook having a first stem and a first curvature operable to support a bag or carrying parcel. There can also be a joint affixed to the end of the first stem. A second hook is also provided having a second stem, a second curvature, and a hollow socket affixed to the end of the second stem. Additionally, the hollow socket can be constructed to retain the first stem. A first hollow portion is also provided where the portion is positioned on the stem of the first hook. There can also be a second hollow retaining portion positioned on the end of the first curvature of the second hook. Each of the first and second hollow portion, enclosed within the stem and curvature of the first hook can be constructed with extension arms, embedded within the hollow portions. Additionally, the joint of the first hook is coupled to the socket of the second hook. Wherein, the first hook and the second hook are positioned to be oriented perpendicular to each other and operable to rotate on a single axis.

In an embodiment of the attachable partition hook, the first hook is vertically aligned to the second hook such that the first curvature directionally opposes the second curvature when rotated in a first direction, when the second hook is engaged over a vertically aligned first edge of a support surface to suspend the carrying parcel from the support surface.

In an embodiment of the attachable partition hook, the first hook and the second hook comprise of a pivot, wherein the pivot is configured to restrict the pivoting motion of the first hook relative to the second hook to a single axis.

In an embodiment of the attachable partition hook, the first hook and the second hook are rotated such that the first curvature directionally encloses the second curvature when rotated in a second direction.

In an embodiment of the attachable partition hook, the first extended portion of the first hollow retaining portion is constructed to rotate about a pivot pin wherein the first extended portion is positioned to extend horizontally away from the stem or perpendicular to the stem.

In an embodiment of the attachable partition hook, the first extending arm is operable to contact a support surface and an adjacent surface such that the support surface maintains alignment to the adjacent surface.

In an embodiment of the attachable partition hook, the second extending arm of the second hollow retaining portion is constructed to rotate about a pivot pin wherein the second extending arm is positioned to extend horizontally away from the first curvature.

In an embodiment of the attachable partition hook, the second extending arm is operable to contact a support surface and an adjacent surface such that the support surface maintains alignment to the adjacent surface.

In an embodiment of the attachable partition hook, the first extending arm of the first hollow retaining portion and the second extending arm of the second hollow retaining portion are positioned on the hook and stem parallel to each other.

In an embodiment of the attachable partition hook, the stem of the first hook comprises a circular extending arm, constructed to make contact with a support surface to provide stability as a result of being weighted by the carrying parcel.

In an embodiment of the attachable partition hook, the first hook is a J-shaped hook and the second hook is a U-shaped hook.

In an embodiment of the attachable partition hook, the first and second hooks are constructed to equally distribute between each hook as a result of being weighted by the carrying parcel.

As such, a user of the tool can hang items, bags, parcels, or another baggage or item with the ability to be supported by the hook, to be suspended or hung from a restroom partition door or wall. While being hung, the door is prevented from opening from the weight of the hung items. The user can release a J shaped piece from the U shaped piece and hang the U shaped piece over a partition door, structure or wall. To keep a door from opening, the user can position the two arms in a downward motion from the U-shaped piece on each side of the door. The user can hang one or more items on the J-shaped piece that hangs down from the U-shaped piece.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

This Summary is provided merely for purposes of summarizing some example embodiments, so as to provide a basic understanding of some aspects of the subject matter described herein.

Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The advantages and features of the present disclosure will become better understood with reference to the following more detailed description and claims taken in conjunction with the accompanying drawings, in which like elements are identified with like symbols. Disclosed herein are embodiments of apparatuses, methods, and systems pertaining to delivering of packages and products from a shipper to a recipient. This description includes drawings, wherein:

Figure 1:
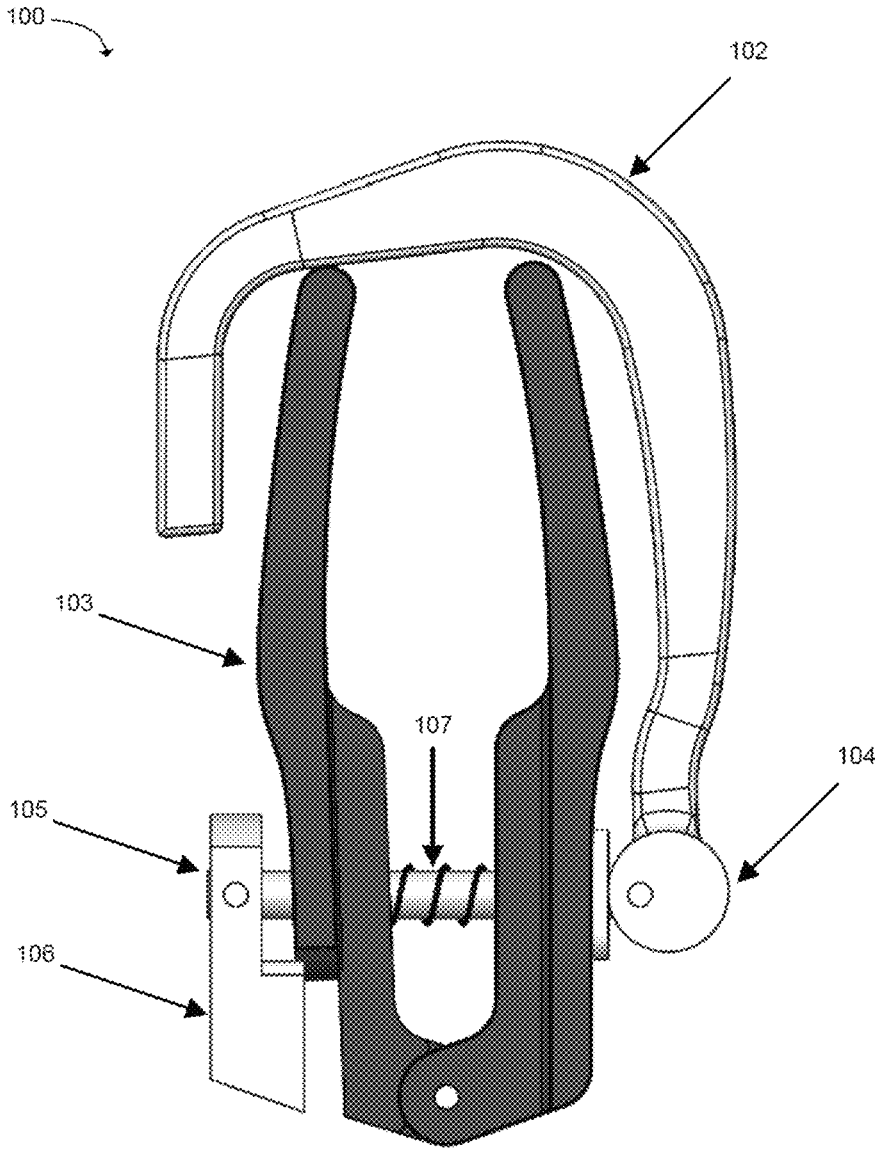
FIG. 1 is a side view of the partition hook in a collapsed state, in accordance with an example.

Elements in the figures are illustrated for simplicity and clarity and have not been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

The following Detailed Description provides specific details for an understanding of various examples of the technology. One skilled in the art will understand that the technology may be practiced without many of these details. In some instances, structures and functions have not been shown or described in detail or at all to avoid unnecessarily obscuring the description of the examples of the technology. It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

The invention may be embodied in other specific forms without departing from the spirit of essential characteristics thereof. The present embodiments therefore to be considered in all respects as illustrative and not restrictive, the scope of the invention being indicated by the appended claims rather than by the foregoing description, and all changes which come within the meaning and range of equivalency of the claims are therefore intended to be embraced therein.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the term "connect," "connected," "connectable" or any variant thereof (including "disconnect," "disconnected," and similar) means two or more components which are or may be connected or disconnected without the use of tools, an adhesive or other chemical bond, or heat bonding (such as welding, brazing, and similar). As used herein, the term "attach," "attached," "attachable" or any variant thereof (including "unattached" and similar) means two or more components which are or may be attached through the use of tools, adhesive or other chemical bond, or heat bonding. Additionally, the words, "herein," "above," "below," and words of similar import, when used in this application, shall refer to this application as a whole and not to particular portions of this application.

The terms "a" and "an" herein do not denote a limitation of quantity, but rather denote the presence of at least one of the referenced items. When the context permits, words using the singular may also include the plural while words using the plural may also include the singular. The word "or," in reference to a list of two or more items, covers all of the following interpretations of the word: any of the items in the list, all of the items in the list, and any combination of one or more of the items in the list.

The following description is not to be taken in a limiting sense, but is made merely for the purpose of describing the general principles of exemplary embodiments. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

An apparatus for an attachable partition hook operable to support a carrying parcel, is disclosed. The apparatus includes a first hook having a first stem and a first curvature. The apparatus includes a joint affixed to an end of a said first stem. The apparatus includes a second hook having a second stem, a second curvature, and a hollow socket affixed to the end of the second stem, wherein the hollow socket is configured to retain the joint of the first stem. The apparatus includes a first hollow retaining portion positioned on the stem of the first hook, wherein the hollow retaining portion comprises of a first extending arm. The apparatus includes a second hollow retaining portion positioned on the end of the first curvature of the second hook, wherein the hollow retaining portion comprises of a second extending arm. The joint of the first hook is coupled to the socket of the second hook, wherein the first hook and the second hook are positioned to be oriented perpendicular to each other and operable to rotate on a single axis.

Figure 2:
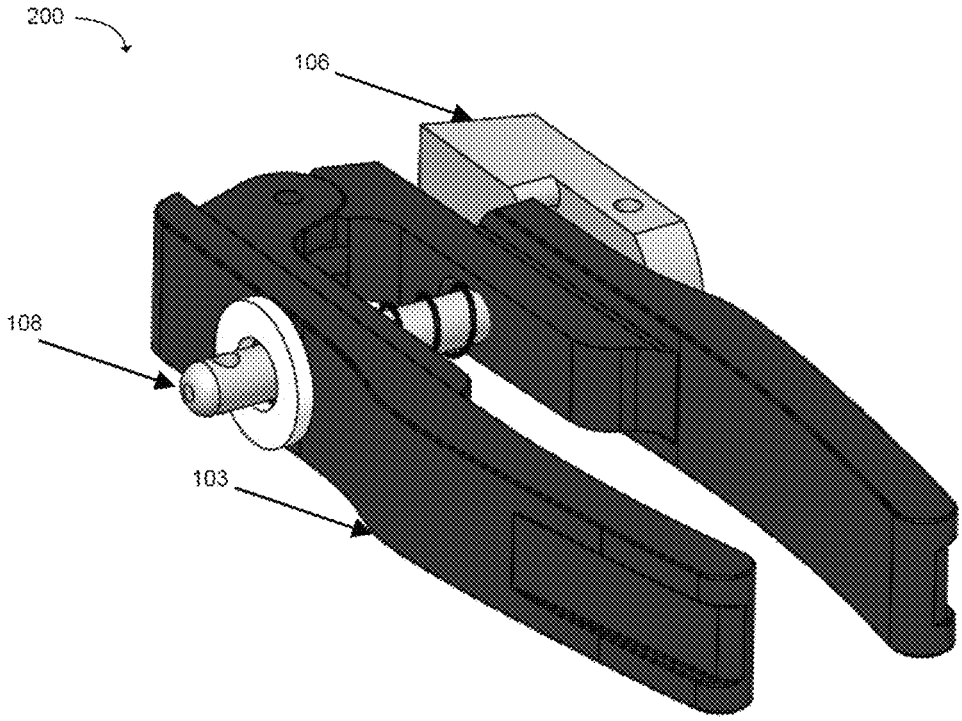
FIG. 2 is a perspective view of the partition hook, in accordance with an example.

FIG. 1 and FIG. 2 comprise of a side view and perspective view of the partition hook device 100 in a collapsed state, respectively. The device 100 in a collapsed view can comprise of a hook 102, a cam mechanism 103, a first hinge 104, a second hinge 105, a short arm 106, and a spring mechanism 107.

The hook 402 is configured to swing downward, on a first hinge 404, in order to receive a weighted object. The weighted object can be one or more of a bag, a garment bag, a carry-on bag, a bookbag, a large luggage, or a duffle bag. Each of these weight objects are configured to carry multiple size articles of clothing, or solid materials that combined will distribute a weight that is supported by the hook 102. The hook is configured to be constructed in a j-shape, with enough of an upward curve to support and secure an object that is suspended from the hook 102.

The hook is configured to open downward, in a first direction, and close, upward, in a second direction via the first hinge 104. The first hinge 104 is further configured to rotate on an axis in a first direction to secure a partition of a swinging door and a stationary door frame. Upon the rotation in the first direction, the short arm 106, located on the opposite side of the book, is configured to rotate downward in order to provide additional support of the weight of the weighted object that is supported by the door. Accordingly, the hook 102 is positioned on the inside of a partition door, and the short arm 106 is positioned on the outside of the partition door.

The cam mechanism 103 is spaced far enough apart in order to slide along the solid door frame. The cam mechanism 103 is configured to make contact with the door frame, where each of the arms are extended across the width of the doorframe, and tightened by a spring mechanism like hinge 107, in order to securely contact the stationary door frame.

Accordingly, the cam mechanism 103 can be configured to operate on a spring mechanism 107, in order to extend or collapse to fit doors of a larger size or a smaller size. The arms of the cam mechanism 103 can be configured to lock the clamp onto the stationary door frame for a more secure lock. The arms of the cam mechanism 103 are configured to tighten on the door frame based on the swinging of the hook in the downward direction, which tightens the spring coil. This will prevent the door from swinging open based on the weight of the bag. The short arm 106 is configured to swing, on a second hinge 105, with the hook 102 to hold the door form either side to ensure that it stays closed.

In one embodiment, the hook 102 is interconnected at a central location by the joint 105. The joint can be any connection means that allows for rotation, support of suspended articles of various sizes, shapes, and weight. The joint 105 can be similar to a ball-and-socket style joint that allows the first hook 101 to be rotatably manipulated 270 or more degrees. The joint 105 can be fabricated from a material similar to the hooks 101, 102.

Further in at the end of the hook 102 can be a heel protruding from the end of the stem of the j-shaped hook and the curvature which provides additional securing of the device 100 onto the desired surface. The foot can also be fabricated to have a slip-resistant surface to enhance engagement with other surfaces, such as a cross-hatched surface, a rough surface, or another tread, and/or a surface made of or covered with a high-tack material such as rubber, silicone rubber, thermoplastic elastomers, thermosetting polymers, or the like. The aforementioned configurations are utilized for storing the device 10 in a pocket, purse, or the suspended article when not in use.

Each of the components of the device 100 can be made of various materials that may be uniform across the structure of the device 100 or non-uniform based on various dependencies such as strength, weight, and balance. Materials used for construction can comprise of one or more of aluminum, steel, stainless steel, magnesium, copper, brass, bronze, alloys thereof, as well as plastics and cross-linking resins, including thermoplastic elastomers and thermosetting polymers, and plastics and cross-linking resins with internal components made of metal. Fabrication techniques may include casting, machining, injection molding, 3D fabrication, pressing, hammering, combinations thereof, or the like.

The joint 105 comprises a socket configured to secure a pin to connect the hook 102, on a rotable axis. Wherein the hook is set pivotably within the socket about an axis transverse to longitudinal axis of an aligned first stem and second stem. The ball is prohibited from rotating in more than a single direction by a non-rotational pin which is positioned through the center of the ball and secured to an interior surface of the socket.

In one embodiment, the hook can be locked into a desired position, via locking mechanism 108. Wherein, the lock can be one or more of a clasp, a rotating lock, a clip, a button, or another fastener suitable for the construction of the device. In one example, there can be opposing scalloped edges upon each inner surface which extend the length of the slot. The scalloped edges include a plurality of equally spaced and opposingly aligned semi-circular indentations. Within this embodiment the edges can be positioned by the user, sufficiently enough to selectably receive a lower end of the first stem and provide resistance to retain the hook 101 at a desired selectable angular position. The locking mechanism 108 is configured to lock the hook 102 in an open position or a closed position.

Figure 3:
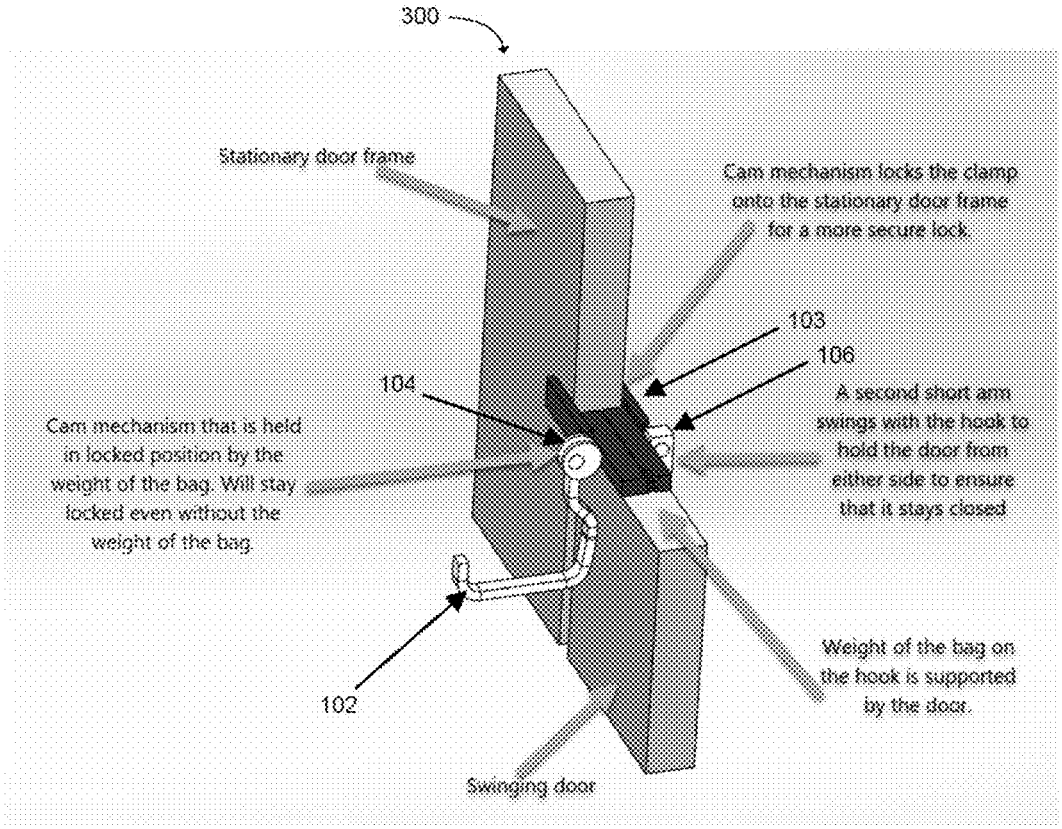
FIG. 3 is an environmental view of the partition hook in use on a support surface, in accordance with an example.

FIG. 3 depicts an environmental view of the partition hook in use on a support surface. The device 100 can be utilized on a horizontal or vertical surface such as a table top, a desk, a restroom stall door, or a similar surface. Each of the mentioned utilizations of the device 100, suspend an article such as, but not limited to: purses, briefcases, luggage, or the like each of which typically include at least one (1) strap or handle for carrying purposes and a compartment for placing various personal or professional articles. In the instance of a restroom stall door, the device comprises a first hook that is positioned on the inside of the stall, configured to hold the article intended to be supported. The hook 102 is positioned on the outside of the door, providing stability for the weight of the suspended article. The hook 102 comprises of a cam mechanism that includes a first arm and a second arm Each of the arms, when extended are perpendicular to the body of the hook, parallel to each other. Each arm can be constructed to be far enough apart when extended to fit the restroom doorframe in between the arms. Additionally, the length of the arms can be configured to be long enough to extend from the device 100 placement on the door, to cover the partition and extend to the support structure, to prevent the door from swinging open due to the weight of the suspended article.

It is envisioned that other styles and configurations can be easily incorporated into the teachings of the present disclosure and only one particular configuration has been shown and described for purposes of clarity and disclosure and not by way of limitation of scope.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

Although the present invention has been described in terms of various embodiments, it is not intended that the invention be limited to these embodiments. Modification within the spirit of the invention will be apparent to those skilled in the art.

What is claimed is:

1. An attachable partition hook operable to support a carrying parcel comprising:

a first arm comprising a curved portion configured to retain the carrying parcel, wherein a distal end of the first arm comprises a first hinge;

a second arm, wherein the second arm is configured to contact an outside portion of a support surface, wherein a distal end of the second arm comprises a second hinge;

a first joint, wherein a first end of the joint is affixed to the first hinge, and a second end of the joint is affixed to the second hinge: and a cam device configured to rest on a top portion of the support surface, comprising a clamp configured to secure the cam device and the support surface to a fixed frame spatially separated from the support surface, wherein the cam device is configured to maintain the support surface in alignment with the fixed frame;

wherein the first arm and the second arm are positioned to be oriented perpendicular to each other and operable to rotate on a single axis;

wherein the first arm is vertically aligned to the second arm such that the curved portion directionally opposes the second arm when rotated in a first direction, when the second arm is engaged over a vertically aligned first edge of a support surface to suspend the carrying parcel from the support surface; and wherein the first arm and the second arm are rotated such that the curved portion is configured to directionally enclose the cam device when rotated in a second direction.

2. The attachable partition hook of claim 1, wherein the partition hook is configured to restrict a pivoting motion of the first arm relative to the second arm to a single axis.

3. The attachable partition hook of claim 2, wherein the second arm is configured to rotate about the the second hinge, wherein the second arm is positioned to extend horizontally away from the curved portion.

4. The attachable partition hook of claim 2, wherein the first arm comprises a stem, the stem comprises a circular extending arm, constructed to make contact with the support surface to provide stability as a result of being weighted by the carrying parcel.

5. The attachable partition hook of claim 1, wherein the first arm is configured to rotate about the first hinge wherein the first arm is positioned to extend horizontally away from the first hinge.

6. The attachable partition hook of claim 1, wherein the first arm and the seond arm are positioned parallel to each other.

7. The attachable partition hook of claim 1, wherein the first arm is a J-shaped hook.

8. The attachable partition hook of claim 1, wherein the first and second arms are constructed to equally distribute a total weight of the carrying parcel between the first arm and the second arm.

* * * * *